US006555769B2

(12) United States Patent
Stefura

(10) Patent No.: US 6,555,769 B2
(45) Date of Patent: Apr. 29, 2003

(54) KEY-TYPE CONTROL DEVICE

(75) Inventor: Eric Stefura, Saint Maure des Fosses (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 09/968,605

(22) Filed: Oct. 2, 2001

(65) Prior Publication Data

US 2002/0056615 A1 May 16, 2002

(30) Foreign Application Priority Data

Oct. 12, 2000 (FR) ..... 00 13073

(51) Int. Cl.[7] ..... H01H 9/00
(52) U.S. Cl. ..... 200/5 R; 200/4; 200/18
(58) Field of Search ..... 200/4, 5 R, 6 R, 200/6 A, 17 R, 18, 329, 339, 1 R, 1 B, 341, 343, 553, 558, 561, 517

(56) References Cited

U.S. PATENT DOCUMENTS 4,769,516 A * 9/1988 Allen ..... 200/5 A
4,877,925 A * 10/1989 Kobayashi ..... 200/343
5,003,133 A * 3/1991 Kobayashi et al. ..... 200/343
5,412,164 A * 5/1995 Conway et al. ..... 200/1 B
5,749,457 A * 5/1998 Castaneda et al. ..... 200/343
5,819,916 A 10/1998 Lee ..... 200/557
5,898,355 A 4/1999 Yu ..... 337/8
6,037,552 A 3/2000 Yamada ..... 200/339

FOREIGN PATENT DOCUMENTS

DE 37 06 681 A1 9/1988 ..... H01H/9/18

* cited by examiner

*Primary Examiner*—Michael Friedhofer
(74) *Attorney, Agent, or Firm*—Liniak, Berenato & White

(57) ABSTRACT

A sequential control device, especially for a scrolling menu, comprises a key (8) mounted movably on a support (2) and able to actuate at least one contactor (16, 18) in response to an external action exerted in a given direction. The key (8) includes an arm (12) having a longitudinal direction, by way of which the contactor (18) is actuated in a direction substantially perpendicular to the longitudinal direction of the arm (12). The longitudinal direction of the arm (12) is substantially parallel to the direction of the external action exerted on the key (8), and the contactor (18) is mounted on a printed-circuit card (14) substantially parallel to the longitudinal direction of the arm (12).

17 Claims, 3 Drawing Sheets

KEY-TYPE CONTROL DEVICE

FIELD OF THE INVENTION

The invention relates to a key-type control device.

BACKGROUND OF THE INVENTION

It relates more particularly to a control device comprising a key mounted pivoting on a support and able to actuate at least one contactor in response to an eccentric push exerted on it in a given direction. It applies, especially, to the sequential control of a scrolling menu for the control of equipment of a motor vehicle.

The equipment of motor vehicles such as the devices for heating or for air-conditioning of the passenger compartment can be controlled mechanically by knobs situated on the facade of the dashboard. They can also be controlled electronically by changeover switches actuated by keys situated on the facade of the dashboard.

Changeover switches of this type are already known. They include a key mounted rocking on an intermediate mechanism plate arranged between the facade of the dashboard and a printed-circuit card. The key acts on one or more distance pieces guided in the intermediate mechanism plate. Each distance piece actuates a contactor such as a pushbutton mounted on the printed-circuit card which is arranged perpendicularly to the direction of movement of the distance pieces.

These known devices exhibit drawbacks. They include a substantial number of pieces. Their assembly is lengthy and intricate. Moreover, the card carrying the contactor is necessarily oriented perpendicularly to the push exerted on the key.

SUMMARY OF THE INVENTION

The present invention remedies these drawbacks. It proposes a control device which includes a reduced number of pieces and which is, moreover, easier and quicker to assemble. Its cost of manufacture is therefore lower.

These objects are achieved, according to the invention, by the fact that the key includes an arm having a longitudinal direction by way of which it actuates the contactor in a direction perpendicular to the longitudinal direction of the arm.

By virtue of these characteristics, the arm acts directly on the contactor, without an intermediate distance piece being present. The number of pieces is therefore reduced.

The control device preferably includes a housing forming the facade, and the key is mounted directly on this housing.

Thus, the intermediate mechanism plate which, in the prior art, would serve as a support and a pivot for the key, is no longer necessary. That being so, the number of pieces is further reduced.

According to one preferred embodiment variant, at least one of the contactors is a selection contactor which makes it possible to select different values by successive manoeuvres, especially values from a scrolling menu.

Thus, via a succession of pushes on the key, or by continuous pressure on this key, the driver of the vehicle or a passenger can run through the various options from a scrolling menu.

The control device preferably further includes a confirmation contactor which makes it possible to confirm the last value selected by means of the selection contactor.

Advantageously, the key is furthermore mounted movable in translation with respect to the confirmation contactor, a push centred on the key making it possible to actuate the confirmation contactor.

Further advantageously, the key is mounted on the support by way of rotational guide means comprising two elongate studs which can turn in respective circular apertures, each aperture including a notch into which the stud can be engaged during the translational movement of the key.

The key can thus perform two movements, namely a rocking movement and translational movement. When it is pressed at an off-centre part, the elongate studs turn in the circular apertures and the selection contactor is actuated. In contrast, when the key is pressed in its central part, the studs engage in the notches and it is the confirmation contactor which is actuated. It is thus possible, simply and by means of a single control device, first of all to make a selection of a value from the scrolling menu then to confirm the value thus selected.

The control device may include a single selection contactor. In this case, the values from the menu scroll in a single direction, and it is necessary to run through a cycle in order to come back to the initial value of the menu.

In another embodiment, the control device includes two parallel selection arms acting in opposite directions on respective contactors.

In this embodiment, when the key is caused to pivot in one direction, the values of the menu are incremented. When the key is made to pivot in the other direction, the values of the menu are decremented. This makes it possible to make a selection more easily without having to run through the set of values of the menu when a desired value has been overshot.

BRIEF DESCRIPTION OF THE DRAWINGS

Other characteristics and advantages of the present invention will emerge further on reading the description which follows of an embodiment example given by way of illustration by reference to the attached figures. In these figures.

DESCRIPTION OF THE PREFERRED EMBODIMENTS

Figure 1:
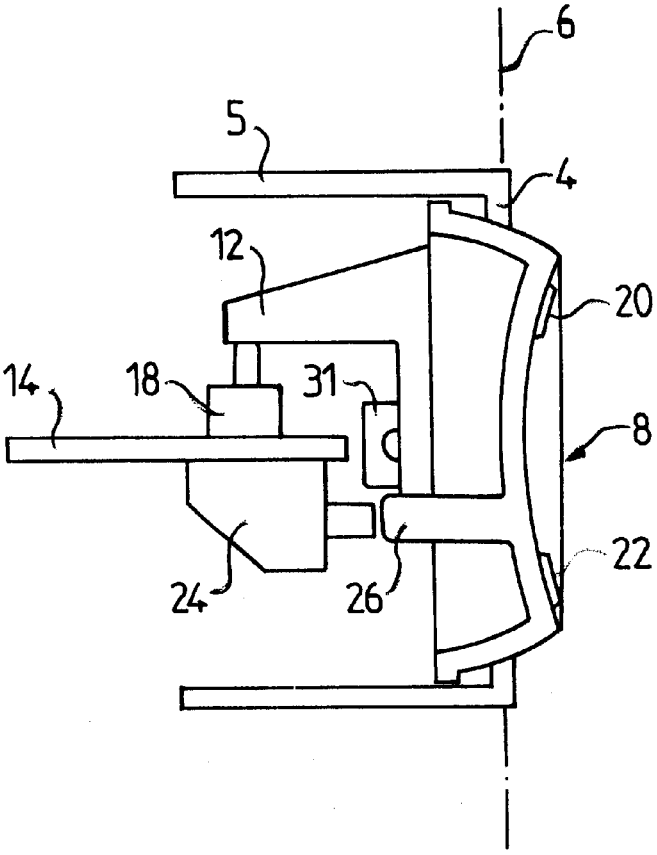
FIG. 1 is a sectional view of a control device in accordance with the present invention.

In FIG. 1, the reference 2 designates a housing including a facade 4 and two wings 5. The facade 4 comes substantially flush with the surface of the dashboard 6 of the vehicle, represented in dots and dashes, and the wings 5 extend towards the front of the vehicle perpendicularly to the facade. A key, designated overall by the reference 8, is mounted pivoting on the housing 2 in a way which will be described later. Advantageously, the key 8 is illuminated by a light source such as a diode (not represented), arranged within the housing, so as to make it more visible in darkness.

Figure 2:
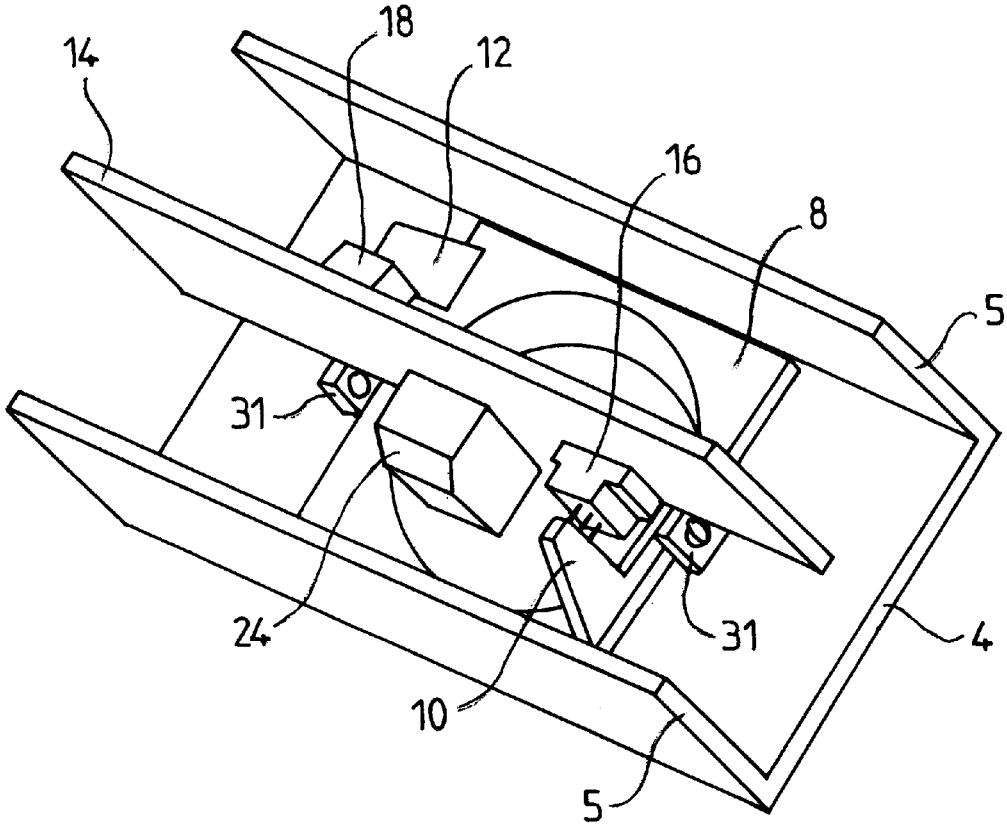
FIG. 2 is a view, in perspective, of the control device represented in FIG. 1.

As can be seen in FIG. 2, the key 8 includes two arms 10 and 12 spaced apart from one another, exhibiting an elongate shape and oriented substantially perpendicularly to the facade 4. A printed-circuit card 14 is arranged perpendicularly to the facade 4 between the arms 10 and 12. The card 14 is mounted fixedly in the housing 2. On one of its faces, turned downwards, the printed-circuit card 14 carries a contactor 16 arranged facing the end of the arm 10. On its other face, the card 14 carries a contactor 18 arranged facing the end of the arm 12. In the example described, the contactors 16 and 18 are pushbuttons. Their axes are perpendicular to the plane of the card 14.

In FIG. 1, the key 8 is represented in its rest position, a position which it occupies when no external action is exerted on it. In contrast, when the driver of the vehicle or a passenger presses on an off-centre part of the key, situated above the plane of the card 14 and marked preferably by a pictogram 20 such as an arrow directed upwards, the key pivots by an angle of 5° to 10° about its axis which is horizontal in the embodiment example represented. As a result of this pivoting movement, the end of the arm 12 pushes in the contact of the pushbuttons 18.

It will thus be observed that the arm 12 is parallel to the plane of the card 14 and that it actuates the pushbutton 16 in a direction perpendicular to its longitudinal direction. This action is direct, that is to say that it takes place without the presence of an intermediate distance piece.

Figure 4:
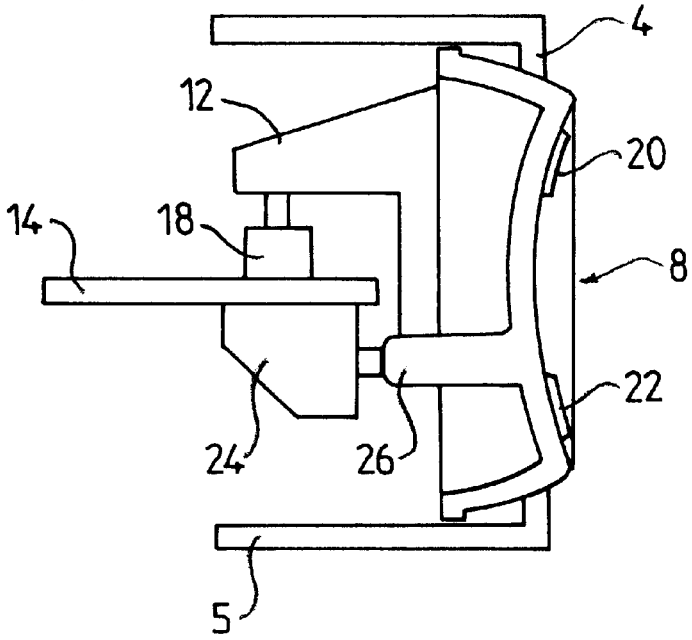

In a variant embodiment (not represented), the card 14 could be arranged parallel to the facade 4 and pushbuttons 16 and 18 could be mounted in such a way that operator has reached the desired value, he releases the pressure on the region 22 and the key 8 resumes its initial position represented in FIG. 1. The confirming of the selected value can be performed by means of a special key. However this could also be performed by means of the key 8 itself, as is the case in the embodiment example represented. To that end, the printed-circuit card 14 supports a confirmation contactor 24. This contactor it is itself a pushbutton. It will be noted that, in contrast to the pushbuttons 16 and 18, it is arranged in such a way that its axis is parallel to the plane of the card 14. The key 8 includes a spigot 26 able to actuate the contactor 24 with which it is aligned. By way of a push exerted on the centre of the key 8, the value selected in the course of the preceding stage by means of the selection contactors 16 and 18 is thus confirmed. This pushed-in position is represented in FIG. 4.

Figure 3:
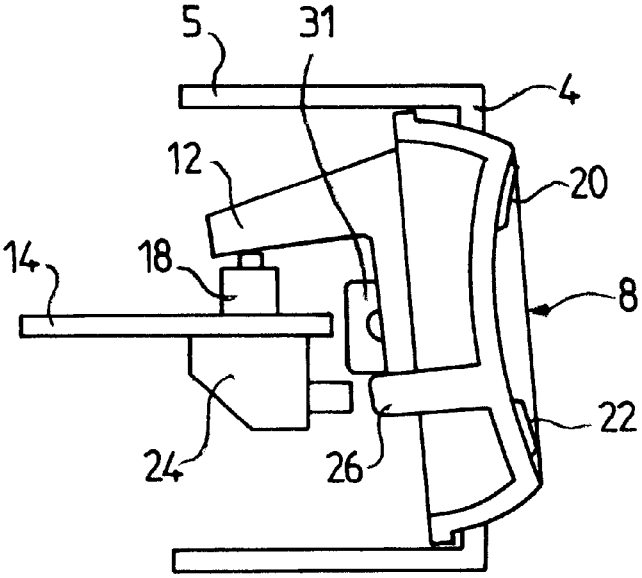
FIGS. 3 and 4 are sectional views of the control device represented in FIGS. 1 and 2 respectively showing a pivoted position and a pushed-in position of the key.
Figure 5:
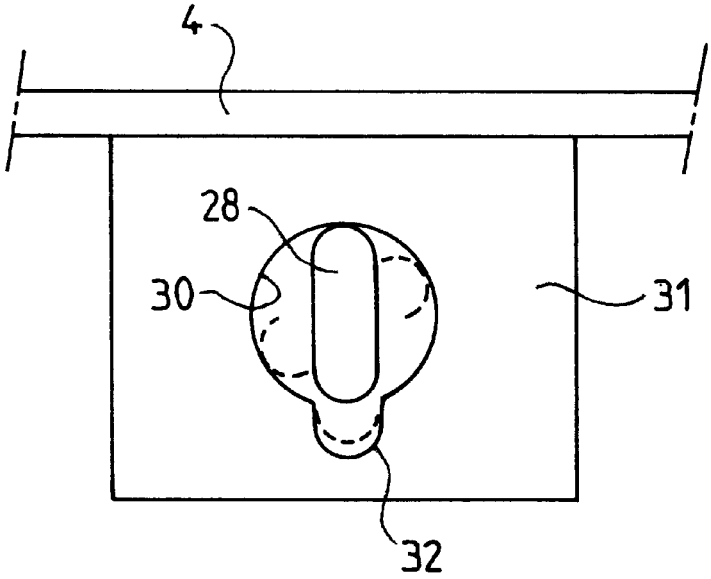
FIG. 5 is a detailed view of the articulation of the key onto the housing of the control device.

As can be observed, the key 8 has to be able to be moved with respect to the housing 2 both in rotation as well as in translation. To that end (see FIG. 5), the key 8 includes two studs 28 which are mutually aligned along its rotational axis on either side of the arms 10 and 12 and of the spigot 26, and elongate in its direction of translation. Each of the studs 28 is engaged in a circular aperture 30 provided in a lug 31 formed within the housing 2. In a variant, the studs could be formed on the housing, and the apertures 30 in a wall of the key 8. A notch 32 is formed in the contour of each circular aperture 30. The width of this notch is slightly greater than that of the elongate stud 28. In the rest position of the key, the studs 28 occupy the position represented in solid line in FIG. 5. The studs 28 are held against the circular part of the aperture by the return spring of the confirmation contactor 24. When an off-centre pressure is exerted on the key 8, for example on the region 20 (see FIG. 3), the elongate stud 28 pivots and moves away in terms of angle from the notch 32, in such a way that the studs 28 can no longer penetrate into this notch. The key 8 is then movable in rotation only. In contrast, if the operator exerts a push on the central part of the key 8 in order to confirm a value chosen from the scrolling menu, as was explained above, each of the two studs 28 starts to penetrate into the notch 32 facing which one of its ends is located in rest position of the key. The key is then locked in rotation. It can no longer pivot and only the confirmation contactor 24 is actuated. The rotational and translational movements are thus clearly separated.

Thus the control device of the invention includes a reduced number of pieces which are easy to assemble, and its cost of manufacture is therefore moderate.

The device more particularly described and represented exhibits the advantage, as set out above, of allowing the same key to fulfil two functions, namely a function of selection via a rocking movement and a function of confirming via a translational movement. Moreover, these two movements cannot be simultaneous so that the confirming can be done only for the value previously selected by the user.

What is claimed is:

1. Control device comprising a key (8) mounted pivoting on a support (2) and able to actuate at least one contactor (16, 18) in response to an eccentric push exerted on said key in a given direction, wherein the key (8) includes an arm (10, 12) having a longitudinal direction, through said arm, the key actuates the contactor (16, 18) in a direction perpendicular to the longitudinal direction of the arm (10, 12);

and the contactor on which the arm acts is a selection contactor (16, 18), said key thereby being adapted to select different values by successive maneuvers.

2. Device according to claim 1, the longitudinal direction of the arm (10, 12) is substantially parallel to the direction of the push exerted on the key (8).

3. Device according to claim 1, wherein said contactor (16, 18) is mounted on a printed-circuit card (14) and wherein the card is substantially parallel to the longitudinal direction of the arm (10, 12).

4. Device according to claim 1, further comprising a housing (2) forming a facade (4), wherein the key (8) is mounted directly onto the housing (2).

5. Device according to claim 1, further including a confirmation contactor (24), said key thereby being adapted to confirm a previous value selected by means of the selection contactor (16, 18).

6. Device according to claim 5, wherein the key (8) is furthermore mounted movable in translation with respect to the confirmation contactor (24), a push centered on the key (8) causing the key to actuate the confirmation contactor (24).

7. Device according to claim 5, wherein the key (8) is mounted on the support (2) by way of rotational guide means comprising two elongate studs (28) which can turn in respective circular apertures (30), each of said circular apertures including a notch (32) into which the respective elongated studs (28) can be engaged during the translational movement of the key (8).

8. Device according to claim 1, further comprising two parallel arms (10,12) acting in opposite directions on respective contactors (16, 18).

9. Control device comprising a key (8) mounted pivoting on a support (2) and able to actuate at least two contactors (16, 18) in response to an eccentric push exerted on said key in a given direction, wherein the key (8) includes two parallel arms (10, 12) having a longitudinal direction, through said arms, the key actuates the contactors (16, 18) in a direction perpendicular to the longitudinal direction of the arm (10, 12); and wherein the two parallel arms (10, 12) act in opposite directions on respective contactors (16, 18).

10. Device according to claim 9, the longitudinal direction of each of the arms (10, 12) is substantially parallel to the direction of the push exerted on the key (8).

11. Device according to claim 9, wherein said contactors (16, 18) are mounted on a printed-circuit card (14) and wherein the card is substantially parallel to the longitudinal direction of the arms (10, 12).

12. Device according to claim 9, further comprising a housing (2) forming a facade (4), wherein the key (8) is mounted directly onto the housing (2).

13. Device according to claim 9, wherein the contactor on which the arm acts is a selection contactor (16, 18), said key thereby being adapted to select different values by successive maneuvers.

14. Device according to claim 13, further including a confirmation contactor (24), said key thereby being adapted to confirm a previous value selected by means of the selection contactor (16, 18).

15. Device according to claim 14, wherein the key (8) is furthermore mounted movable in translation with respect to the confirmation contactor (24), a push centered on the key (8) causing the key to actuate the confirmation contactor (24).

16. Device according to claim 14, wherein the key (8) is mounted on the support (2) by way of rotational guide means comprising two elongate studs (28) which can turn in respective circular apertures (30), each of said circular apertures including a notch (32) into which the respective elongated studs (28) can be engaged during the translational movement of the key (8).

17. Control device comprising a key (8) mounted pivoting on a support (2) and having at least one arm adapted to actuate at least one contactor (16, 18) in response to an eccentric push exerted on said key in a given direction and a spigot (26) adapted to actuate at least one additional contactor (24), wherein the at least one arm (10, 12) defines a longitudinal direction, and wherein through said arm the key actuates the contactor (16, 18) in a direction perpendicular to the longitudinal direction of the arm (10, 12) and through said spigot (26) the key actuates the additional contactor (24) via translational movement of said key.

* * * * *